US009046289B2

(12) United States Patent
Price

(10) Patent No.: US 9,046,289 B2
(45) Date of Patent: Jun. 2, 2015

(54) REFRIGERATION SYSTEM

(75) Inventor: Daniel L. Price, Bloomington, MN (US)

(73) Assignee: THERMO KING CORPORATION, Minneapolis, MN (US)

( * ) Notice: Subject to any disclaimer, the term of this patent is extended or adjusted under 35 U.S.C. 154(b) by 222 days.

(21) Appl. No.: 13/443,190

(22) Filed: Apr. 10, 2012

(65) Prior Publication Data

US 2013/0263612 A1 Oct. 10, 2013

(51) Int. Cl.

| | |
|---|---|
| ***F25B 43/02*** | (2006.01) |
| ***F25B 43/00*** | (2006.01) |
| *F25B 47/02* | (2006.01) |

(52) U.S. Cl.

CPC ..... *F25B 43/006* (2013.01); *F25B 47/022* (2013.01); *F25B 2400/0403* (2013.01); *F25B 2400/0411* (2013.01); *F25B 2400/0415* (2013.01); *F25B 2500/28* (2013.01); *F25B 2500/01* (2013.01)

(58) Field of Classification Search

CPC ..... F25B 42/006; F25B 47/022; F25B 2400/0411; F25B 2400/0403; F25B 2500/28; F25B 2400/0415

USPC ..... 62/84, 85, 503, 151, 196.4, 278

See application file for complete search history.

(56) References Cited

U.S. PATENT DOCUMENTS

| | | | | | |
|---|---|---|---|---|---|
| 3,283,524 | A | * | 11/1966 | Byron | 62/115 |
| 3,420,071 | A | | 1/1969 | Bottum | |
| 3,609,990 | A | * | 10/1971 | Bottum | 2/217 |
| 3,636,723 | A | * | 1/1972 | Kramer | 62/197 |
| 3,643,465 | A | | 2/1972 | Bottum | |
| 3,643,466 | A | | 2/1972 | Bottum | |
| 3,677,025 | A | * | 7/1972 | Payne | 62/81 |
| 3,766,744 | A | * | 10/1973 | Morris, Jr. | 62/73 |
| 3,779,035 | A | * | 12/1973 | Kramer | 62/503 |
| 3,792,594 | A | * | 2/1974 | Kramer | 62/503 |
| 3,837,173 | A | * | 9/1974 | Kuttruff et al. | 62/128 |
| 3,858,407 | A | * | 1/1975 | Schumacher | 62/217 |
| 4,068,493 | A | * | 1/1978 | Micai et al. | 62/194 |
| 4,217,765 | A | | 8/1980 | Ecker | |
| 4,324,106 | A | * | 4/1982 | Ross et al. | 62/197 |

(Continued)

FOREIGN PATENT DOCUMENTS

| | | |
|---|---|---|
| JP | 53041847 | 4/1978 |
| JP | 05306855 | 11/1993 |
| JP | 07294064 | 11/1995 |

OTHER PUBLICATIONS

PCT/US2013/035621 International Search Report and Written Opinion dated Jul. 8, 2013 (11 pages).

*Primary Examiner* — Mohammad M Ali

(74) *Attorney, Agent, or Firm* — Hamre, Schumann, Mueller & Larson, P.C.

(57) ABSTRACT

A horizontal suction accumulator generally includes a tank, an inlet tube, and an outlet tube. The tank extends in a horizontal direction and is configured to receive a refrigerant. The refrigerant includes a vapor and a liquid. The tank stores the liquid refrigerant and discharges the vapor refrigerant. The inlet tube supplies into the tank an inlet stream that includes the liquid and vapor refrigerants. The inlet tube extends into the tank and is bent upward at an acute angle. The liquid refrigerant is stored in the tank. The vapor refrigerant is discharged through the outlet tube, which extends offset from the inlet tube and into the tank. The inlet tube defines an inlet opening positioned at a first elevation, the outlet tube defines an outlet opening positioned at a second elevation, and the first and second elevations are substantially the same.

14 Claims, 3 Drawing Sheets

(56) References Cited

U.S. PATENT DOCUMENTS

| | | | | |
|---|---|---|---|---|
| 4,496,378 | A * | 1/1985 | Kish | 96/139 |
| 4,583,377 | A | 4/1986 | Viegas | |
| 5,184,479 | A | 2/1993 | Koberstein et al. | |
| 5,735,139 | A | 4/1998 | Lord et al. | |
| 5,787,729 | A | 8/1998 | Wiyaya | |
| 5,868,001 | A * | 2/1999 | Shoulders | 62/503 |
| 5,887,444 | A | 3/1999 | Toyoshima et al. | |
| 5,996,360 | A * | 12/1999 | Tanaka et al. | 62/160 |
| 6,463,757 | B1 * | 10/2002 | Dickson et al. | 62/503 |
| 6,564,575 | B1 * | 5/2003 | Schroeder et al. | 62/503 |
| 6,574,987 | B2 | 6/2003 | Takeuchi et al. | |
| 6,701,745 | B1 * | 3/2004 | Kozinski | 62/503 |
| 7,032,395 | B2 * | 4/2006 | Hanson et al. | 62/151 |
| 7,152,427 | B2 | 12/2006 | Haussmann | |
| 7,461,519 | B2 * | 12/2008 | Fralick et al. | 62/503 |
| 7,584,625 | B2 * | 9/2009 | Wu et al. | 62/228.1 |
| 7,658,079 | B2 * | 2/2010 | Bailey et al. | 62/181 |
| 7,930,899 | B2 | 4/2011 | Lyun-Su | |
| 2002/0095948 | A1 * | 7/2002 | Corrigan et al. | 62/503 |
| 2004/0118148 | A1 | 6/2004 | Ther et al. | |
| 2006/0123833 | A1 | 6/2006 | Flanigan | |
| 2008/0011550 | A1 | 1/2008 | Dunn et al. | |
| 2008/0014854 | A1 | 1/2008 | Tigner | |
| 2011/0126566 | A1 | 6/2011 | Jones et al. | |

* cited by examiner

REFRIGERATION SYSTEM

BACKGROUND

Transport refrigeration systems such as for trucks, trailers, and shipping containers utilize a refrigerant to cool cargo within a cargo space of the cargo container. In operation, the refrigerant is compressed at a compressor, directed through a condenser to remove the heat of compression to the atmosphere, and directed through an evaporator to absorb heat from air that is being circulated through the cargo space before returning to the compressor. A suction accumulator tank is typically disposed between the evaporator and the compressor. The function of the accumulator is to collect liquid refrigerant that may exit the evaporator and prevent it from entering the compressor.

SUMMARY

In one embodiment, a refrigeration system generally includes a compressor, a condenser, an evaporator, and a tank. The compressor receives a vapor refrigerant and compresses the vapor refrigerant to form a compressed refrigerant. The condenser receives the compressed refrigerant, whereupon the compressed refrigerant is condensed to form a liquid refrigerant. The evaporator receives the liquid refrigerant and vaporizes at least a portion of the liquid refrigerant, thereby forming the vapor refrigerant and a remaining liquid refrigerant. The vapor refrigerant and the remaining liquid refrigerant are discharged from the evaporator. The tank receives the vapor refrigerant and the remaining liquid refrigerant from the evaporator, stores the remaining liquid refrigerant, and discharges the vapor refrigerant. The tank extends in a horizontal direction and includes an inlet tube and outlet tube. The inlet tube extends into the tank and is bent upward at an acute angle. The outlet tube extends offset from the inlet tube and into the tank. The inlet tube defines an inlet opening positioned at a first elevation. The outlet tube defines an outlet opening positioned at a second elevation. The first and second elevations are substantially the same.

In another embodiment, a horizontal suction accumulator generally includes a tank, an inlet tube, and an outlet tube. The tank extends in a horizontal direction and is configured to receive a refrigerant. The refrigerant includes a vapor and a liquid. The tank stores the liquid refrigerant and discharges the vapor refrigerant. The inlet tube supplies the refrigerant. The inlet tube extends into the tank and is bent upward at an acute angle. The outlet tube discharges the vapor refrigerant. The outlet tube extends offset from the inlet tube and into the tank. The inlet tube defines an inlet opening positioned at a first elevation, the outlet tube defines an outlet opening positioned at a second elevation, and the first and second elevations are substantially the same.

In still another embodiment, a method of storing a liquid refrigerant in a horizontal tank generally includes supplying an inlet stream into the tank through an inlet tube. The inlet stream includes the liquid refrigerant and a vapor refrigerant. The liquid refrigerant is stored in the tank. The vapor refrigerant is discharged through an outlet tube. The inlet tube is bent upward at an acute angle and defines an inlet opening positioned at a first elevation. The outlet tube defines an outlet opening positioned at a second elevation. The first and second elevations are substantially the same.

Other aspects of the invention will become apparent by consideration of the detailed description and accompanying drawings.

It should be understood that the invention is not limited in its application to the details of construction and the arrangements of the components set forth in the following description or illustrated in the above-described drawings. The invention is capable of other embodiments and of being practiced or being carried out in various ways. Also, it is to be understood that the phraseology and terminology used herein is for the purpose of description and should not be regarded as limiting.

DETAILED DESCRIPTION

Figure 1:
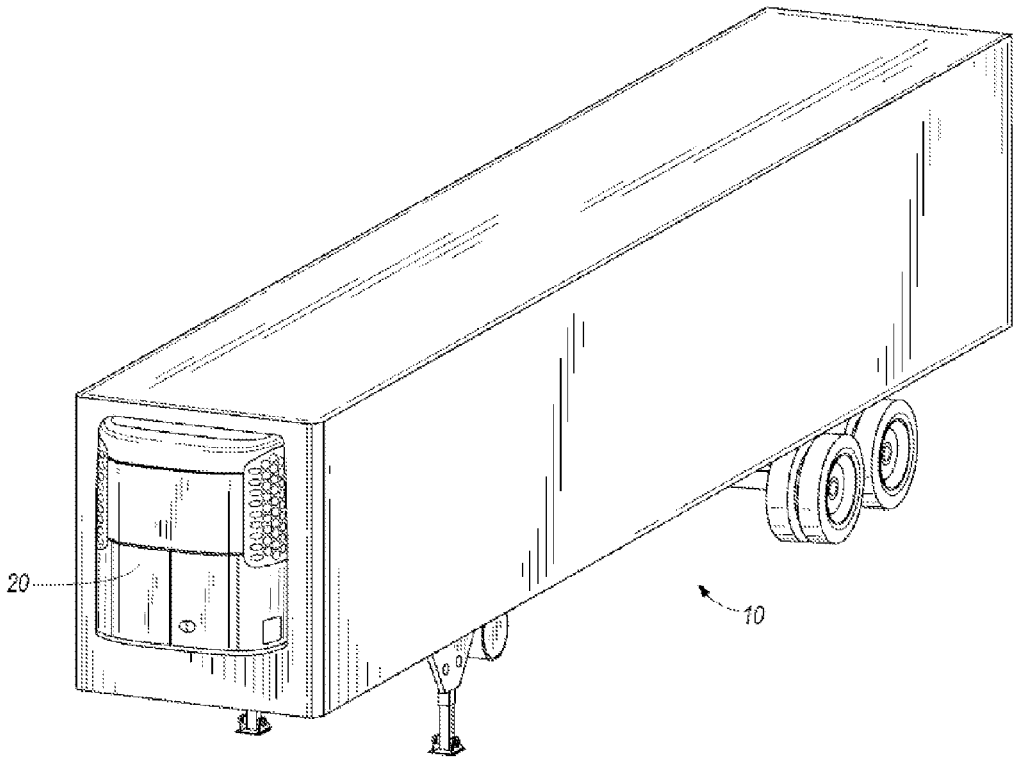
FIG. 1 is a perspective view of a trailer with a transport refrigeration unit attached thereto.

FIG. 1 is a perspective view of a trailer 10 with a transport refrigeration unit 20 attached thereto. The transport refrigeration unit 20 includes a refrigeration system 25 utilizing a refrigerant to cool cargo within a cargo space of the cargo container. Although FIG. 1 illustrates the transport refrigeration unit 20 attached to the trailer 10, it is to be appreciated that the transport refrigeration unit 20 may instead be attached to a truck, a shipping container, a rail car, or other transportable container capable of storing cargo.

Figure 2:
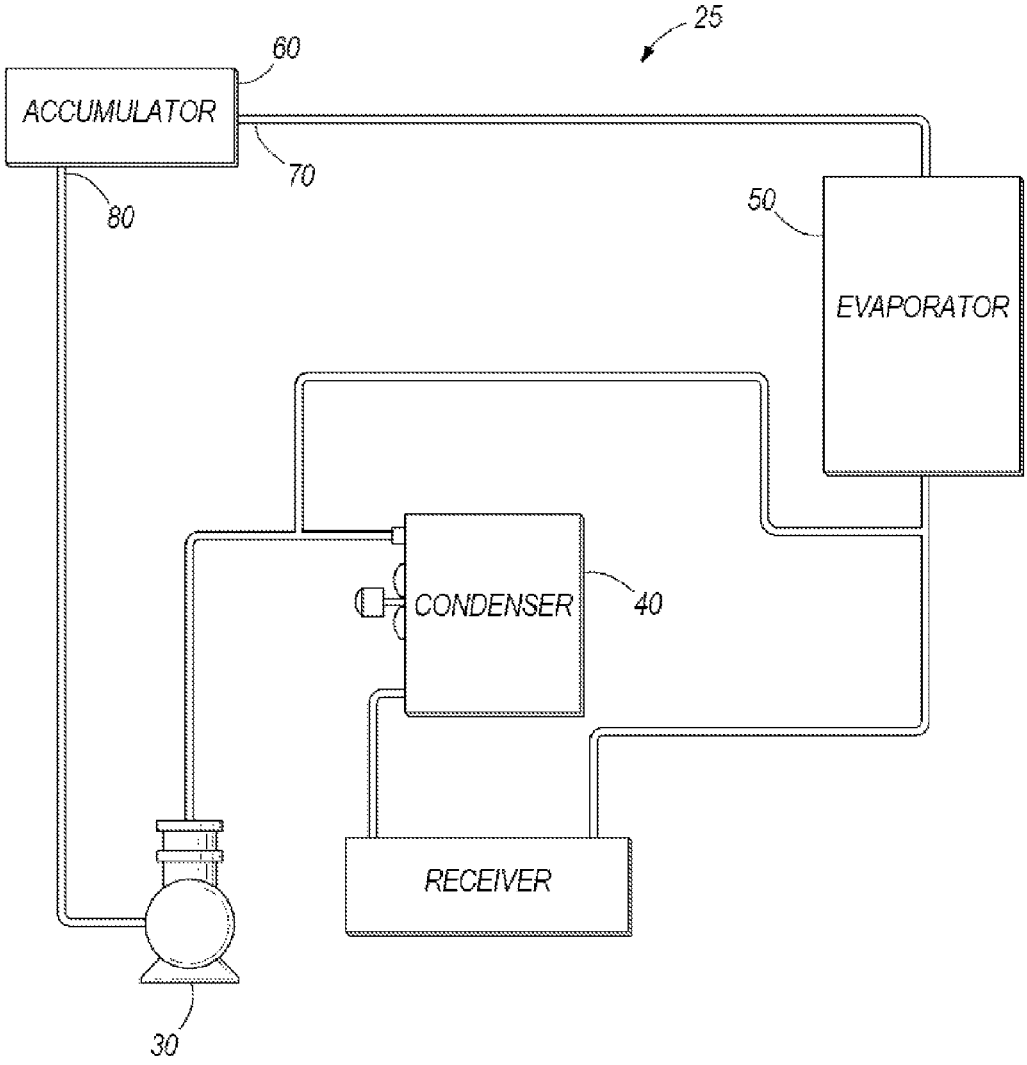
FIG. 2 is a schematic illustration of a refrigeration system of the transport refrigeration unit of FIG. 1.

Referring also to FIG. 2, the refrigeration system 25 generally includes a compressor 30, a condenser 40, an evaporator 50, and a suction accumulator tank 60. In a cooling mode, the compressor 30 receives a vapor refrigerant and compresses the vapor refrigerant to form a compressed refrigerant. The condenser 40 receives the compressed refrigerant, whereupon heat of the refrigerant is transferred to ambient air passed through the condenser such that the compressed refrigerant is condensed to form a liquid refrigerant. The evaporator 50 receives the liquid refrigerant and heat from air passing through the evaporator 50, and vaporizes at least a portion of the liquid refrigerant, thereby forming the vapor refrigerant and a remaining liquid refrigerant. The cooled air is then circulated into the trailer to cool cargo stored within the trailer 10. The vapor refrigerant and the remaining liquid refrigerant are discharged from the evaporator 50. When operating in a heating or a defrost mode, the evaporator 50 can also receive at least a portion of the compressed refrigerant from the compressor 30.

The accumulator tank 60 is disposed between the evaporator 50 and the compressor 30. The function of the tank 60 is to collect liquid refrigerant that may exit the evaporator 50 and prevent it from entering the compressor 30. If large amounts of the liquid refrigerant suddenly enter the compressor 30, the compressor 30 may be damaged. To substantially avoid the unwanted flow of liquid into the compressor, the tank 60 receives the vapor refrigerant and the remaining liquid refrigerant from the evaporator 50, stores the remaining liquid refrigerant, and discharges the vapor refrigerant. The storage of liquid refrigerant is particularly important when the refrigeration system 25 is operating in the heating or defrost mode, where significantly more liquid refrigerant may accumulate in the accumulator than when operating in the cooling mode. For example, when the refrigeration system 25 is operating in the heating or defrost mode, the heat input to the liquid refrigerant may result in the liquid refrigerant boiling over. The boil-over of the liquid refrigerant may cause frothing and splashing of the liquid refrigerant such that excessive liquid refrigerant is carried over into the compressor, which is sometimes called "slugging."

Slugging may damage a head of the compressor 30 and other moving compressor parts, thereby shortening the useful operating life of the compressor 30. Severe slugging may potentially destroy the compressor 30. Thus, an additional function of the tank 60 is to substantially prevent slugging. By preventing slugging, the tank 60 can also increase the heating or cooling capacity of the refrigeration system 25.

Figure 3:
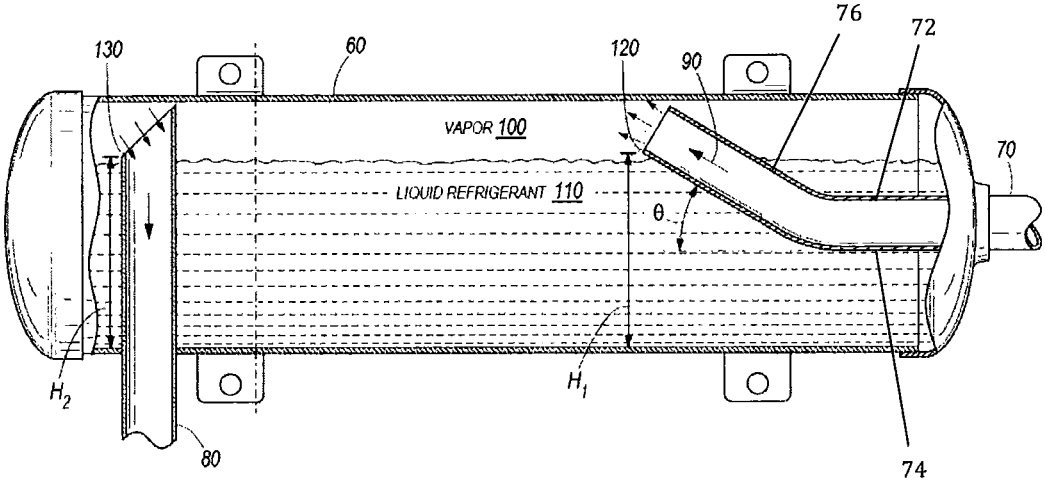
FIG. 3 is sectional view of a horizontal suction accumulator embodying the invention.

FIG. 3 illustrates the tank 60 according to one embodiment of the invention. The tank 60 extends in a horizontal direction and includes an inlet tube 70 and outlet tube 80. The inlet tube 70 includes a tank section 72, the tank section includes a horizontal portion 74 and a bent portion 76. The horizontal portion of the inlet tube 70 extends into the tank 60 and the bent portion 76 is bent upward at an acute angle θ. In the illustrated embodiment, the angle θ is approximately 30°. The acute angle θ can be relatively easy to achieve in the inlet tube 70, compared to other configurations that may include, for example, a perpendicular bend or a U-shape. In particular, a sharp bend with a perpendicular or obtuse angle θ may require a small bending radius, which in turn can require a high load or force in manufacturing. Moreover, a sharp with a perpendicular or obtuse angle θ may result in distorting the substantially circular cross section of the inlet tube 70 to an oval shape. Such cross-sectional distortion can create an undesirable mismatch between the inlet tube 70 and a corresponding opening in the tank 60 through which the inlet tube 70 is introduced. Thus, to increase manufacturability of the inlet tube 70 and the tank 60, the inlet tube 70 angle θ is acute.

The inlet tube 70 supplies an inlet stream 90 into the tank 60. The inlet stream 90 includes vapor refrigerant 100 and the remaining liquid refrigerant 110 from the evaporator 50. The acute angle θ of the inlet tube 70 can facilitate suitably deflecting the inlet stream 90 off of an upper portion of the tank 60, thereby separating the liquid refrigerant 110 from the vapor refrigerant 100 in the tank 60. Additionally, the acute angle θ of the inlet tube 70 can reduce the pressure drop that may occur in the vapor refrigerant 100. In some embodiments, the tank 60 also receives oil from the evaporator 50, and the inlet tube 70 angle θ is so dimensioned as to facilitate the separation of the oil from the liquid refrigerant 110. The liquid refrigerant 110 is stored in the tank 60. As a result of the inlet tube 70 angle θ, an inlet opening 120 is positioned at a first elevation $H_1$ relative to a bottom surface of the horizontal tank 60, and suitably above a top surface or head of the stored liquid refrigerant 110. If the inlet tube 70 were not bent, the inlet opening 120 through which the inlet stream 90 is supplied would be positioned close to a top surface of the stored liquid refrigerant 110, causing undesirable agitation of the liquid refrigerant 110 as the inlet stream 90 flows in the tank 60. Such agitation may develop a high-density foam that could spill over into the outlet tube 80. Thus, in some embodiments, the inlet tube 70 angle θ is so dimensioned as to substantially prevent foaming or agitation of the stored liquid refrigerant 110.

The outlet tube 80 extends offset from the inlet tube 70 and into the tank 60. The outlet tube 80 discharges the vapor refrigerant 100. An outlet opening 130 is positioned at a second elevation $H_2$ relative to a bottom surface of the tank 60. As a result of the inlet tube 70 angle θ, the first and second elevations $H_1$, $H_2$ are substantially the same. As such, the tank 60 can hold as much liquid refrigerant 110 as possible for the space available.

Although the invention has been described in detail with reference to certain preferred embodiments, variations and modifications exist within the scope and spirit of one or more independent aspects of the invention as described.

What is claimed is:

1. A refrigeration system comprising:

a compressor for receiving a vapor refrigerant and compressing the vapor refrigerant to form a compressed refrigerant;

a condenser for receiving the compressed refrigerant, whereupon the compressed refrigerant is condensed to form a liquid refrigerant;

an evaporator for receiving the liquid refrigerant, vaporizing at least a portion of the liquid refrigerant, thereby forming the vapor refrigerant and a remaining liquid refrigerant, and discharging the vapor refrigerant and the remaining liquid refrigerant; and a tank for receiving the vapor refrigerant and the remaining liquid refrigerant from the evaporator, the tank storing the remaining liquid refrigerant and discharging the vapor refrigerant, wherein the tank extends in a horizontal direction and includes an inlet tube extending into the tank and being bent upward at an acute angle; and an outlet tube extending offset from the inlet tube and into the tank, wherein the inlet tube defines an inlet opening positioned at a first elevation, the outlet tube defines an outlet opening positioned at a second elevation, and the first and second elevations are substantially the same, wherein the inlet tube includes a tank section disposed within the tank, the tank section including a horizontal portion extending in the horizontal direction, and a bent portion adjacent to the horizontal portion and bent upward from the horizontal portion at the acute angle.

2. The system of claim 1, wherein the inlet tube angle is so dimensioned as to substantially prevent foaming or agitation of the stored liquid refrigerant.

3. The system of claim 1, wherein the tank also receives oil from the evaporator, and further wherein the inlet tube angle is so dimensioned as to facilitate the separation of the oil from the liquid refrigerant.

4. The system of claim 1, wherein the inlet tube angle is approximately 30°.

5. The system of claim 1, wherein the evaporator receives at least a portion of the compressed refrigerant for defrosting.

6. A horizontal suction accumulator comprising:

a tank extending in a horizontal direction, the tank configured to receive a refrigerant, the refrigerant including a vapor and a liquid, the tank storing the liquid refrigerant and discharging the vapor refrigerant;

an inlet tube for supplying the refrigerant, the inlet tube extending into the tank and being bent upward at an acute angle; and an outlet tube for discharging the vapor refrigerant, the outlet tube extending offset from the inlet tube and into the tank, wherein the inlet tube defines an inlet opening positioned at a first elevation, the outlet tube defines an outlet opening positioned at a second elevation, and the first and second elevations are substantially the same, wherein the inlet tube includes a tank section disposed within the tank, the tank section including a horizontal portion extending in the horizontal direction, and a bent portion adjacent to the horizontal portion and bent upward from the horizontal portion at the acute angle.

7. The accumulator of claim 6, wherein the inlet tube angle is so dimensioned as to substantially prevent foaming or agitation of the liquid refrigerant.

8. The accumulator of claim 6, wherein the inlet tube also supplies oil, and further wherein the inlet tube angle is so dimensioned as to facilitate the separation of the oil from the liquid refrigerant.

9. The accumulator of claim 6, wherein the inlet tube angle is approximately 30°.

10. A method of storing a liquid refrigerant in a horizontal tank, the method comprising:

supplying an inlet stream into the tank through an inlet tube, the inlet stream including the liquid refrigerant and a vapor refrigerant;

storing the liquid refrigerant in the tank; and discharging the vapor refrigerant through an outlet tube, wherein the inlet tube is bent upward at an acute angle and defines an inlet opening positioned at a first elevation, the outlet tube defines an outlet opening positioned at a second elevation, and the first and second elevations are substantially the same, supplying the inlet stream through a tank section of the inlet tube, wherein supplying the inlet stream through the tank section of the inlet tube includes:

directing the inlet stream through a horizontal portion of the tank section that extends in the horizontal direction, and directing the inlet stream through a bent portion of the tank section that is adjacent to the horizontal portion and is bent upward from the horizontal portion at the acute angle.

11. The method of claim 10, wherein the liquid refrigerant is separated from the vapor refrigerant in the tank by deflecting the inlet stream off of an upper portion of the tank.

12. The method of claim 10, wherein the inlet tube angle is so dimensioned as to substantially prevent foaming or agitation of the liquid refrigerant.

13. The method of claim 10, wherein the inlet stream also includes oil, and further wherein the inlet tube angle is so dimensioned as to facilitate the separation of the oil from the liquid refrigerant.

14. The method of claim 10, wherein the inlet tube angle is approximately 30°.

* * * * *